US009027714B2

(12) United States Patent
Husmann et al.

(10) Patent No.: US 9,027,714 B2
(45) Date of Patent: May 12, 2015

(54) ACTUATING AND RESETTING A SAFETY GEAR

(75) Inventors: Josef Husmann, Lucerne (CH); David Michel, Thalwil (CH); Astrid Sonnenmoser, Ebikon (CH); Hans Kocher, Udligenswil (CH); Karl Weinberger, Immensee (CH)

(73) Assignee: Inventio AG, Hergiswil (CH)

( * ) Notice: Subject to any disclaimer, the term of this patent is extended or adjusted under 35 U.S.C. 154(b) by 533 days.

(21) Appl. No.: 13/327,064

(22) Filed: Dec. 15, 2011

(65) Prior Publication Data

US 2012/0152659 A1 Jun. 21, 2012

(30) Foreign Application Priority Data

Dec. 17, 2010 (EP) ..... 10195781

(51) Int. Cl.
*B66B 5/18* (2006.01)
*B66B 5/22* (2006.01)

(52) U.S. Cl.
CPC .... *B66B 5/22* (2013.01); *B66B 5/18* (2013.01)

(58) Field of Classification Search
CPC ..... B66B 5/18; B66B 5/22; B66B 5/24
USPC ..... 187/371–373, 376
See application file for complete search history.

(56) References Cited

U.S. PATENT DOCUMENTS

| | | | | |
|---|---|---|---|---|
| 5,096,020 | A * | 3/1992 | Korhonen | 187/376 |
| 5,782,319 | A * | 7/1998 | Woodruff et al. | 187/376 |
| 6,173,813 | B1 | 1/2001 | Rebillard et al. | |
| 7,575,099 | B2 | 8/2009 | Oh et al. | |
| 2008/0017456 | A1 | 1/2008 | Ito | |
| 2012/0152663 | A1 * | 6/2012 | Legeret et al. | 187/404 |
| 2014/0008157 | A1 * | 1/2014 | Terry et al. | 187/359 |

FOREIGN PATENT DOCUMENTS

| | | | | |
|---|---|---|---|---|
| EP | 0543154 | A1 | 5/1993 | |
| EP | 1400476 | A1 | 3/2004 | |
| EP | 1637495 | A2 | 3/2006 | |
| EP | 1902993 | A1 | 3/2008 | |
| EP | 2058262 | B1 | 5/2009 | |
| WO | WO 2008057116 | A1 * | 5/2008 | B66B 5/22 |

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

A device can actuate and reset a safety gear in an elevator system. The device contains a pressure accumulator, possibly a compression spring, which, in case of need, can move at least two engagement elements of the safety gear essentially synchronously into an engaged position, and a remotely actuatable resetting device, which can retension the pressure accumulator into a ready position.

19 Claims, 10 Drawing Sheets

ACTUATING AND RESETTING A SAFETY GEAR

CROSS-REFERENCE TO RELATED APPLICATION

This application claims priority to European Patent Application No. 10195781.9, filed Dec. 17, 2010, which is incorporated herein by reference.

FIELD

The disclosure relates to actuating and resetting a safety gear in an elevator system.

BACKGROUND

Elevator systems are built into buildings. The former can include an elevator car which, via suspension ropes or suspension belts, is connected to a counterweight or to a second elevator car. By means of a drive, which can be chosen to act on the suspension means or directly on the car or counterweight, the car is moved along essentially vertical guiderails. The elevator system is used to transport persons and goods between one or more floors in the building.

The elevator system contains apparatus to secure the elevator car in case of failure of the drive, or of the suspension means, or to prevent undesired drifting away or falling when stopped at a floor. For this purpose, safety gears are generally used which, in case of need, can brake the elevator car on the guiderails.

Traditionally, such safety gears can be actuated by mechanical overspeed governors. Today, however, electronic monitoring devices are also increasingly used which, in case of need, can activate braking apparatus or safety gears. So as to be able nonetheless to rely on known and proven safety gears, electromechanical actuating units can be required which, when correspondingly triggered, can actuate safety gears.

From EP0543154 such a device is known. By its means, in case of need, an auxiliary caliper brake is brought into engagement with a guiderail, and this auxiliary caliper brake actuates an existing lever system, by means of which safety gears are actuated. This auxiliary caliper brake is designed to be able to move the lever system and mass components of the safety gear. The necessary electromagnetic units are dimensioned correspondingly large.

From U.S. Pat. No. 7,575,099 a further such device is known. In this solution, in case of need, engagement wedges of a safety gear are actuated directly by springs. The springs are pretensioned by an electromagnet and, in case of need, the pretensioned springs are released. The springs can be reset or retensioned again by means of a spindle drive. This electromagnet can be dimensioned correspondingly large, since the entire prestressed force of a plurality of springs should be absorbed and held.

SUMMARY

At least some of the disclosed embodiments can provide at least one alternative solution to actuating and resetting a safety gear in an elevator system by means of triggering, and to its integration in the elevator system. This solution, or these solutions, can in at least some cases be combined with conventional safety gears. Further aspects, such as rapid actuation of the safety gear, lower energy requirements, simple installation, behavior of the device in the case of power failure or component failure, should also be taken into account.

An elevator system serves to transport goods and persons in a building. For this purpose, the elevator system contains at least one elevator car, to accommodate the persons and goods, as well as generally a counterweight. Counterweight and elevator car are connected together via a suspension rope, a suspension belt, or another suspension means. These suspension means are passed over a return pulley or traction sheave, and the counterweight and the elevator car thereby move in opposite directions in the building, more precisely in an elevator hoistway that is provided in the building. To prevent the car, and also the counterweight, as the case may be, from falling, or also to prevent other faulty behavior of these traveling bodies ("traveling body" being hereinafter understood to mean either the elevator car or the counterweight), at least the elevator car, and in some cases also the counterweight, is equipped with a safety gear. The traveling body generally contains two safety gears, each of which is assigned to a guiderail. The guiderails —generally two guiderails—guide the traveling body along the elevator hoistway and contain a web on which the safety gear can engage for the purpose of braking. An embodiment of a conventional safety gear contains two engagement wedges. The engagement wedges are mounted and guided in the safety gear in vertically displaceable manner. In normal operation of the elevator system, the engagement wedges are in a lower, ready position. In case of need, by means of a device for actuating and resetting the safety gear, the engagement wedges are pushed upward along an inclined guide track until they grip the web of the guiderail. As the safety gear or traveling body continues to move, the frictional force caused by gripping now moves the engagement wedges further in a housing of the safety gear as far as a wedge stop. As a result of this further movement, the housing, acted on by a spring, is pressed on by the wedge action of the engagement wedges. This pressing-on ultimately determines a press-on force of the engagement wedge on the web of the guiderail, and thereby a braking force, which brakes the traveling body.

In some embodiments, the device for actuating and resetting the safety gear contains a single pressure accumulator which, in case of need, moves the two engagement wedges of the safety gear described above essentially synchronously from the ready position as far as the web of the guiderail into an engagement position. The device possibly further contains a remotely controlled resetting device, which is designed to retension the pressure accumulator into a ready position. This occurs when the traveling body should be released after braking and testing of the safety state of the elevator system has taken place. The shared pressure accumulator enables safe actuation of the safety gear, since both wedges can be actuated simultaneously and free of gripping. The shared pressure accumulator can also be simply coupled to a safety gear, for example via a lever system. Self-evidently, also other types of safety gear, such as, for example, a roller safety gear, can be correspondingly actuated, in such types of safety gear, engagement rollers or other engagement means are actuated instead of engagement wedges.

In a variant embodiment, the pressure accumulator contains a compression spring which is stressed by means of a resetting device and which, in case of need, can release this stress to actuate the engagement wedges. The compression spring is preferably so designed that, should a coil fracture—with loss of a coil length and detensioning of the spring by this amount of length—, sufficient residual force is present to actuate the engagement wedges. The use of a compression spring can enable provision of a safe and inexpensive device for actuating and resetting the safety gear. Self-evidently, other pressure accumulators are also possible. For example, the use of a pneumatic or hydraulic pressure accumulator is also possible.

In a further or augmentary variant embodiment, the device for actuating and resetting the safety gear contains an actuator, which is mounted in swivelable manner about an essentially horizontal swivel axle. The actuator is connected at one end to the engagement wedges, and at the other end to the pressure accumulator, and holds the engagement wedges in this ready position, as well as being able, in case of need, to move the engagement wedges into their engaged position when the pressure accumulator or compression spring is released. The pressure accumulator is thus connected to the engagement wedges via levers. Advantageously, a lever distance to the engagement wedges is kept large, and a lever distance to the pressure accumulator is kept relatively small. By this means, rotating inertia masses can be minimized, which in turn enables rapid, and therefore also safe, actuation of the engagement wedges.

In a further or augmentary variant embodiment, the engagement wedges are connected to the actuator by a fastening strip. The engagement wedges are thereby guided by the actuator. This prevents an engagement wedge, for example as a result of oscillations or one-sided contact with the guiderail, from suddenly being independently actuated and thereby causing an undesired braking. Use of an actuator of this type also allows a spacesaving embodiment of the device for actuating and resetting the safety gear, since it can be arranged, for example, at the side of the safety gear so as not to require additional hoistway height.

In a variant embodiment, the actuator contains a swiveling body which is mounted in swiveling manner on the horizontal swivel axle. This swiveling body is connected at one end to two lever arms. The two lever arms connect the swiveling body to the engagement wedges. The former can be embodied in such manner that they can follow a lateral displacement of the engagement wedges during actuation. This lateral displacement results when the engagement wedges are pushed upward along their inclined guide track. This lateral compensation can be made possible by the two lever arms being fastened to the swivel body by means of lateral joints, or by the two lever arms having a high lateral elasticity. Self-evidently, the lever arms are also rigid in the vertical direction to enable rapid actuation of the engagement wedges.

In a variant embodiment, the actuators in their entirety, and in particular the two lever arms, are embodied with low mass. This can be effected, for example, by the arrangement of drilled holes in unloaded neutral axles of the lever arms. This can mean that mass inertias are also thereby by reduced. Low mass inertias can mean that rapid actuation of the safety gear can be effected.

The swivel body is further connected to a control arm. This control arm connects the swivel body to the pressure accumulator or compression spring respectively, and to a restraining device. In normal operation of the elevator system, the restraining device holds the actuator in the ready position. The stress force of the pressure accumulator is thereby conducted directly via the control arm to the restraining device. The lever arms are thereby relieved of this force transmission and only support the engagement wedges.

Possibly, the arrangement of the actuator is so chosen that the lever arms press the engagement wedges upward from below, and the control arm is arranged on the opposite side of the swivel axle. This allows the pressure accumulator to be arranged in simple manner above the control arm, and therefore at the side of the safety gear. As a result, the device for actuating and resetting the safety gear requires no additional building height.

In a further or augmentary variant embodiment, the restraining device is controlled by an electromagnet. In normal operation of the elevator system, the electromagnet pulls on a restraining latch of the restraining arresting device and thereby holds the actuator against the force of the pressure accumulator in the ready position. When the electromagnet is deenergized, a latching spring presses the restraining latch open, and the pressure accumulator can press the engagement wedges via the actuator into their engagement position. Furthermore, the restraining latch is sometimes embodied in such manner that it can be moved essentially without force. This can be achieved by a curved rail, which interacts with a restraining nose of the actuator, being correspondingly formed. A holding force of the electromagnet can hence be embodied small, since essentially only the restraining latch is held in its position.

In a variant embodiment, the device for actuating and resetting the safety gear is provided with switches or sensors for monitoring the state of the device. A first position sensor possibly monitors an operating setting of the actuator and therefore simultaneously an operating position of the engagement wedges. This first position sensor is possibly executed as a safety switch. It signals to a control of the elevator system that the safety gear is in a braking position, so that the control can terminate or block a travel. The signal is generally fed directly into a safety circuit of the elevator system. The safety of the elevator system and of its users can thereby be increased, and a stipulation of safety regulations can thereby be inexpensively and reliably fulfilled.

Possibly, the device for actuating and resetting the safety gear contains a second position sensor, which monitors a position of the restraining latch of the restraining device. This second position sensor is possibly embodied in the form of a microswitch. It can be used not only to control the resetting device but also, or alternatively, for secondary monitoring of the device for actuating and resetting the safety gear. By this means, for example, falling off or tearing off of the restraining latch can be rapidly detected, and a control can also, in case of need, actuate further brakes, or at least rapidly bring the elevator system to a standstill. Also by this means, a check of the function of the first position sensor can be performed, since generally with open restraining latch this first position sensor must also rapidly signal an actuated safety gear.

In a variant embodiment, the restraining device is mounted via a resetting lever swivelably on the swivel axle of the actuator. The remotely actuatable resetting device can move the restraining device in controlled manner from a ready position into a resetting position and, after engagement of the restraining latch of the restraining device in the control arm of the swivel body, the restraining device together with the control arm into the ready position again. Together with movement of the control arm into the ready position, the pressure accumulator or compression spring is thereby stressed into the ready position again.

In a further, or augmentary, variant embodiment, a third position sensor is provided, possibly also as a microswitch. This can monitor the ready position of the resetting device. Resetting of the device for actuating and resetting the safety gear can thereby be automated.

In a further or augmentary variant embodiment, the resetting device contains a spindle thread with a spindle drive and a spindle slider which is moved by a spindle of the spindle drive. The spindle slider is connected to the resetting lever, by means of which the spindle thread can move the resetting lever. On account of the swivel axle being common with the actuator, the return lever can be made to follow exactly the movement curve of the actuator. This can allow exact positioning of the restraining device. Alternatively, instead of the spindle thread with spindle drive, a hydraulically or pneumatically actuated resetting device can be used. In this case, instead of the spindle slider, a hydraulically or pneumatically actuated slider can be used.

Hence overall, by means of the restraining latch, which is controlled by the electromagnets, in a device of such type for actuating and resetting the safety gear, upon release of the restraining latch, the engagement wedges can be rapidly actuated and the actuation that occurs can be rapidly detected. By means of the second position switch, a function of the first position switch can be monitored, and, when using a plurality of devices for actuating and resetting the safety gear, should inadvertent opening occur of one of the restraining latches, the other parallel-acting safety gears can be rapidly brought into action. Unsymmetrical braking can thereby be prevented.

Additionally safe prevention of unsymmetrical braking can be achieved by the electromagnets of parallel acting safety gears being connected in series with their devices for actuating and resetting the safety gear. On interruption of the coil of a holding magnet, a current flow over both holding magnets is inevitably directly interrupted, and the two parallel acting safety gears are actuated synchronously and/or symmetrically.

By means of the second and third position sensor, resetting of the device for actuating and resetting the safety gear can be further controlled.

By reference to an example, such a control process can proceed as follows. Braking is triggered by switching off a control circuit of the electromagnets. The restraining latch releases the actuator, and the pressure accumulator pushes the engagement wedges into the engaged position. In the engaged position, the automatic gripping of the engagement edges on the web of the guiderails takes place through friction, and the first position switch or safety switch interrupts the safety circuit of the elevator system, whereby any driving means are brought to a standstill. The second position switch, which monitors the position of the restraining latch, is monitored in the same manner. Through gripping of the engagement wedges, the safety gear generates a corresponding braking force and brings the traveling body to a standstill.

A service specialist, or correspondingly instructed person, investigates the state of the system and/or the cause of the braking, and prepares the return to operation of the elevator system.

The service specialist will generally first release any persons who are present in the elevator car. For this purpose, by means of an evacuation control, the service specialist moves the elevator car in upward direction, i.e. against the direction of engagement, to the next stop. The engagement wedges are thus moved backward by the friction between the engagement wedge and the web of the guiderail, the pressure accumulator being thereby partly retensioned. The elevator system is hereby further secured against unexpected sliding away, since the engagement wedges are further pressed into the engaged position by the pressure accumulator. This means that the safety gear would immediately brake if the car were to, for example, move downward again.

After any persons have left the elevator car, the service specialist initializes inter alia resetting of the device for actuating and resetting the safety gear. Via a control circuit of the resetting device, the resetting device now guides the spindle slider, and the return lever that is connected to the spindle slider, along with the restraining device, to the actuator. The third position switch detects that the resetting device has left its at-rest position. As soon as the restraining device reaches the actuator, the actuator, or the restraining nose that is arranged on the actuator, presses the restraining latch back again to the meanwhile reactivated electromagnet. This holds the restraining latch tight again and the second position switch is reset. This switching position is also the control command for the resetting device to pull the spindle slider back again, now also with the actuator. In doing so, the pressure accumulator is tensioned. As soon as the spindle slider has reached its at-rest position, the third position switch switches and terminates the resetting process. In a normal resetting process, also the first position switch or safety switch is reset. The safety gear, together with the device for actuating and resetting the safety device, is again ready for operation.

During this resetting, should rapid response of the safety gear be required independent of the progress of resetting, the safety gear can be rapidly reactuated through release of the electromagnets.

On the other hand, should the safety gear during the resetting attempt still be in the gripping position, the restraining latch would be torn open again when pulling the return lever back, and the resetting would have to be reinitialized.

Here, it is apparent that the return lever, together with the restraining latch, on account of the swivel axle being common to the actuator, is made to follow exactly the movement curve of the actuator. This allows exact positioning of the restraining device.

In a further variant embodiment, the resetting device has a force-limiting device which, when a predetermined resetting force is exceeded, decouples the restraining device from the resetting device. This can be expedient when, for example, the traveling body is moved simultaneously with actuation of the resetting device. The engagement wedges, which would then by friction be pressed back out of an engaged position, could be pressed by the actuator against the resetting device. To avoid overloading the resetting device in this situation, when the predefined resetting force is exceeded, the restraining device is uncoupled from the resetting device.

In a variant embodiment, the device has a mechanical lock which enables blocking of the device in the ready position. This is helpful, since normally during installation of an elevator system, the devices of the elevator system are not electrically connected. Blocking allows simple installation of the device for actuating and resetting the safety gear. Preferably, when the mechanical lock is built in, the first position sensor, or the safety switch, or the second position switch, remains inevitably interrupted. By this means, an inadvertent putting into operation of the elevator system without removal of the mechanical block is prevented.

In a variant embodiment, the device for actuating and resetting a safety gear is built into a housing, or the housing is a component of the device. This housing is formed and provided with fastening strips in such manner that the device can be mounted on a safety gear. As already stated at the outset, safety gears today are generally actuated by means of a lever mechanism which is actuated by a governor rope. These safety gears generally contain a lower connecting point which allows fastening of guide shoes. The present formed housing is embodied in such manner that it can be mounted on these connecting points. The fastening strip is, for example, bolted between the guide shoe and the safety gear. By this means, the device for actuating and resetting the safety gear can be mounted on an existing elevator system or existing safety gear. It can therefore be suitable for the modernization of elevator systems.

The device for actuating and resetting the safety gear can be used together with a corresponding safety gear in various configurations in elevator systems.

In a variant configuration, a pair of safety gears with associated devices for actuating and resetting the safety gears is arranged on the car. The devices for actuating and resetting the safety gears are triggered by an electronic governor, and the resetting device is controlled by a brake control device. The electronic governor, for example, controls directly, or via the corresponding brake control device, the electromagnets of the devices for actuating and resetting the safety gears. The electromagnets are possibly, as already described above, connected in series.

The electronic governor can, for example, be a speed monitoring device such as is used in WO03004397, or it can be a monitoring device which evaluates a rotational speed of rollers on the car which roll along the guiderails, or it can be a safety monitoring system such as is presented in EP1602610. The electronic governor and the associated device are possibly equipped with electrical energy storage devices such as batteries, accumulators, or capacitor batteries. With the aid of these energy stores, in the case of a power failure in the building, the safety device is kept active for a predefined time.

Instead of a pair of safety gears, a plurality of pairs of safety gears, with in each case respective associated devices for actuating and resetting the safety gear, can be mounted on the car.

In an augmentary variant configuration, the counterweight is equipped with one or more pairs of safety gears with associated devices for actuating and resetting the safety gears. This is sometimes necessary in elevator systems with long transporting heights, or in elevator systems where there are further rooms below the elevator, such as, for example, basement or garage rooms. Also possible in these counterweights are electronic governors, as these are shown in the car. In a modified variant configuration, however, the counterweight has no speed governor of its own, but the counterweight is triggered by a car-side safety system via signal conductors which are, for example, integrated in a compensating rope.

In a further variant configuration, the counterweight has an electronic governor of its own and a brake control device of its own for resetting the device for actuating and resetting the safety gear. The electronic governor contains, for example, rollers, which are arranged on the counterweight where they roll along the guiderails of the counterweight. At least two rollers are equipped with rotational speed detectors. By reference to the two rotational speed detectors, the speed of the counterweight is determined, and on detection of an excessive speed, the device for actuating and resetting the safety gear is actuated so that the counterweight is safely brought to a standstill.

The counterweight can be supplied with electrical energy via the compensating rope, and status signals can be transmitted via a communication bus. The communication bus can take the form of a power-line connection or a separate data conductor.

Self-evidently, a supply of electrical energy to the counterweight can take place from accumulators which are, for example, fed by a generator which can be integrated in the rollers, or which are charged in a respective recharging cycle. A resetting command can, for example, be transmitted wirelessly. A status signal of the safety gear, or of the device for actuating and resetting the safety gear, can equally well be transmitted wirelessly.

In another variant configuration, the counterweight is equipped with a safety gear, which is actuated by means of a slack-rope monitor only in the case of a lost suspension force. In this case, the safety gear on the counterweight is only actuated on loss of the suspension force at the counterweight, which is the case, for example, on failure of a suspension means. To prevent inadvertent triggering, for example caused by rope oscillations, the slack-rope monitor is provided with a damping element, such as a pneumatic damper, or with a trigger delay. A trigger delay is, for example, a distance that is traveled by a slack-rope trigger before a safety gear is actuated. Travel distances of approximately 50 to 150 mm are adequate to sufficiently delay a slack-rope trigger in elevator systems with a travel speed of up to 1.6 m/s. A damping element, for example an oil damper, is advantageously designed to delay triggering of the suspension gear by up to 0.5 seconds.

An advantage of this variant is that, although no electrical connection of the counterweight to the elevator system is necessary, the counterweight is nonetheless effectively secured against falling. A possible erroneous triggering of the safety gear on the counterweight can be monitored on the car or on the drive, since on triggering of this safety gear, a sudden large change of load on the drive results.

In another variant configuration of an elevator system, the safety gear, or the device for actuating and resetting the safety gear, is additionally triggered by a detection device for detecting an undesired traveling away of the elevator car from a standstill. In a particular embodiment of such a detection device, in case of need a follower wheel is pressed against a track of the elevator car. In normal operation, the follower wheel is at a distance from the track and is not driven. The detection device contains a sensor which detects a rotation of the follower wheel by a predefined angle of rotation from standstill when it is pressed against the track, and which, when the predefined angle of rotation is exceeded, interrupts the control circuit to the electromagnets of the device for actuating and resetting the safety gear. The safety gear is thereby actuated and a further slipping away of the elevator car is prevented.

Combinations of the variant configurations shown for the counterweight and car are also possible. Also possible are counterweights without fall prevention of any sort, if the proposed safety gears are arranged only on the car.

BRIEF DESCRIPTION OF THE DRAWINGS

The disclosed technologies are explained below in relation to an exemplary embodiment by reference to the figures. Shown are in.

In the figures, the same reference numbers and letters are used for identically functioning parts in all figures.

DETAILED DESCRIPTION

Figure 1:
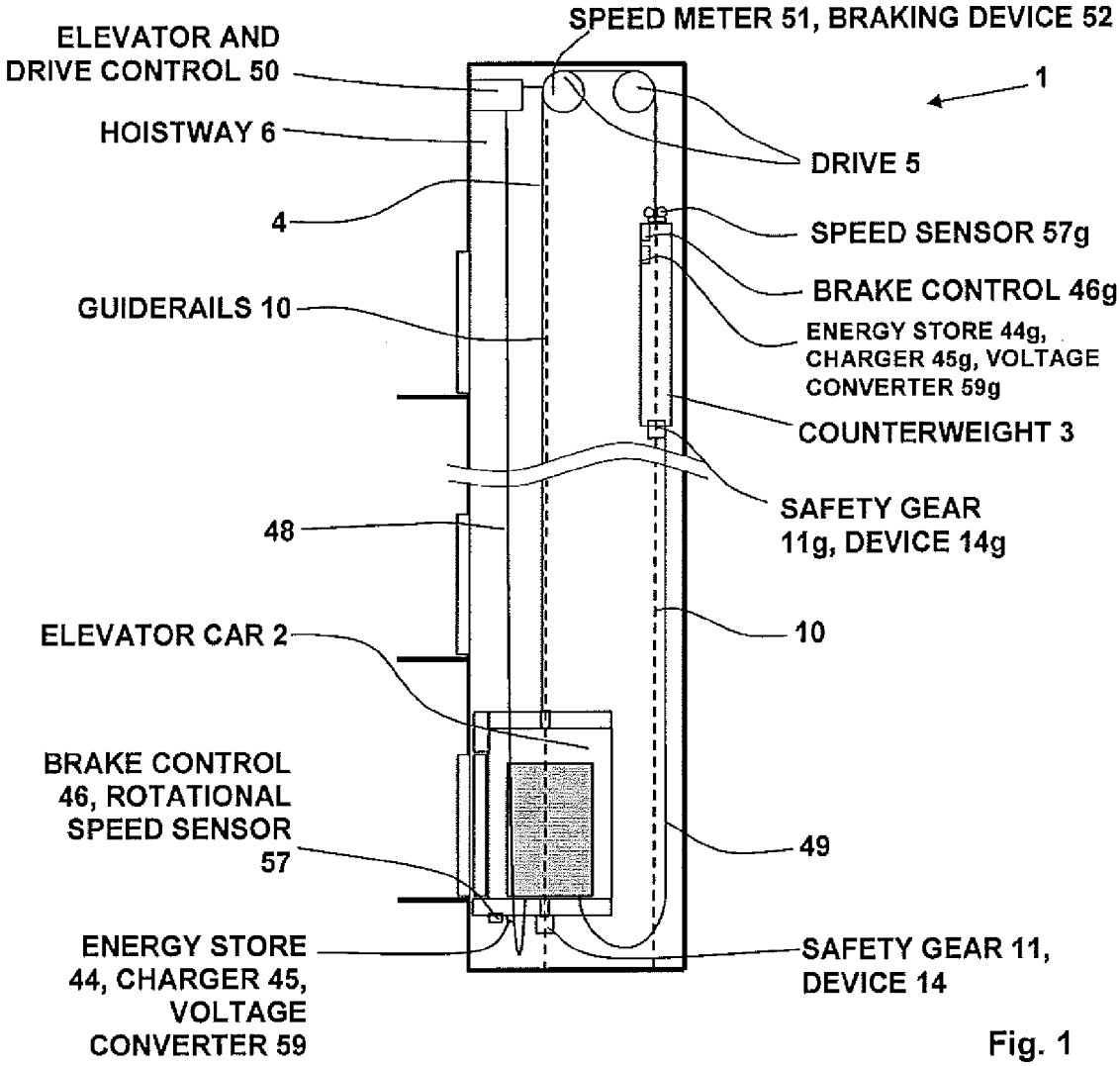
FIG. 1 a diagrammatic view of an elevator system.
Figure 2:
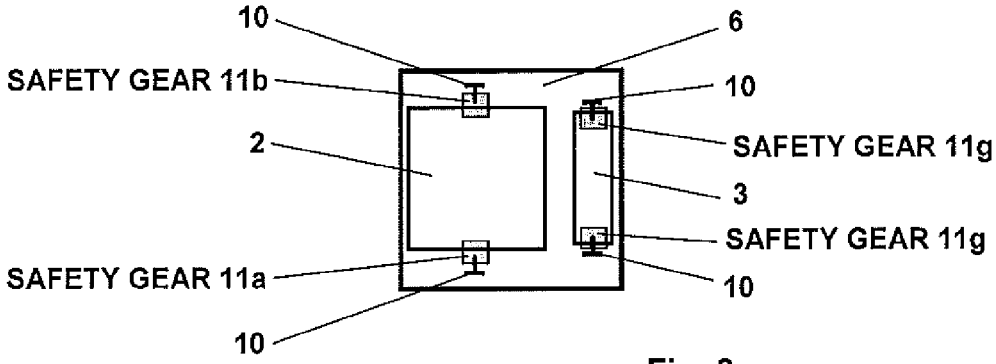
FIG. 2 a diagrammatic plan view of the elevator system of FIG. 1.

FIGS. 1 and 2 together show a diagrammatic elevator system 1 in an overall view. The elevator system 1 is built into a building, or into an elevator hoistway 6 of a building, and serves to transport persons or goods within the building. The elevator system 1 contains an elevator car 2, which can move upward and downward along guiderails 10. The elevator car 2 is accessible from the building via doors. A drive 5 serves to drive and hold the elevator car 2. The drive 5 is arranged in the upper area of the elevator hoistway 6, and the car 2 is connected by suspension means 4, for example suspension ropes or suspension belts, to the drive 5. The suspension means 4 are passed over the drive 5 and further to a counterweight 3. The counterweight compensates part of the mass of the elevator car 2, so that the drive 5 must essentially only compensate an imbalance between the car 2 and the counterweight 3. The drive 5 is arranged, for example, in the upper area of the elevator hoistway 6. It could self-evidently also be arranged at another location in the building, or in the area of the car 2, or of the counterweight 3. The drive 5 generally contains a rotational-speed meter 51, which measures a true rotational speed of the drive machine and transmits it to an elevator and drive control 50. The elevator and drive control 50 regulates and monitors the elevator operation, it controls the drive 5 and actuates any braking devices 52 of the drive unit 5. The elevator and drive control 50 is generally connected via a communication bus to other control and monitoring devices of the elevator system. The elevator and drive control 50 is generally connected by a traveling cable 48 to the car 2. Through this traveling cable 48, the car is supplied with electrical energy, and the traveling cable 48 also contains the necessary communication conductors.

The elevator and drive control 50 can self-evidently be embodied in a single housing. Various functional groups of the elevator and drive control 50 can, however, also be arranged in their own housings at different locations in the elevator system.

The elevator car 2 is equipped with a safety gear 11 or, in the example, with a pair of safety gears 11*a*, 11*b*, which is/are suitable for securing and/or delaying the elevator car 2 in the event of unexpected movement, or overspeed, or at a stop. The safety gear 11, 11*a*, 11*b* is, for example, arranged under the ear 2.

The safety gear 11, or each of the safety gears 11*a*, 11*b*, is respectively connected to a device 14, 14*a*, 14*b* for actuating and resetting the safety gear. The device 14, 14*a*, 14*b* for actuating and resetting the safety gear is connected to a brake control 46, which can trigger the device 14, 14*a*, 14*b* for actuating and resetting the safety gear for the purpose of actuating the safety gear 11, 11*a*, 11*b*, and also for resetting the device 14, 14*a*, 14*b*. The brake control 46 contains an electronic governor, or a corresponding speed sensor 57, or is connected to such a one. This makes it possible to dispense with a mechanical speed governor such as is normally used. The electronic governor, or the corresponding speed sensor 57, is embodied as already described in the general section, and is not explained in more detail here. The electronic governor, or the respective speed sensor 57, can self-evidently be arranged directly on the car 2, or signals from the elevator control 50 can also be used.

In the example shown, the device 14, 14*a*, 14*b* for actuating and resetting the safety gear and the brake control 46 are connected to an energy store 44 with associated charger 45 and voltage converter 59.

Figure 4:
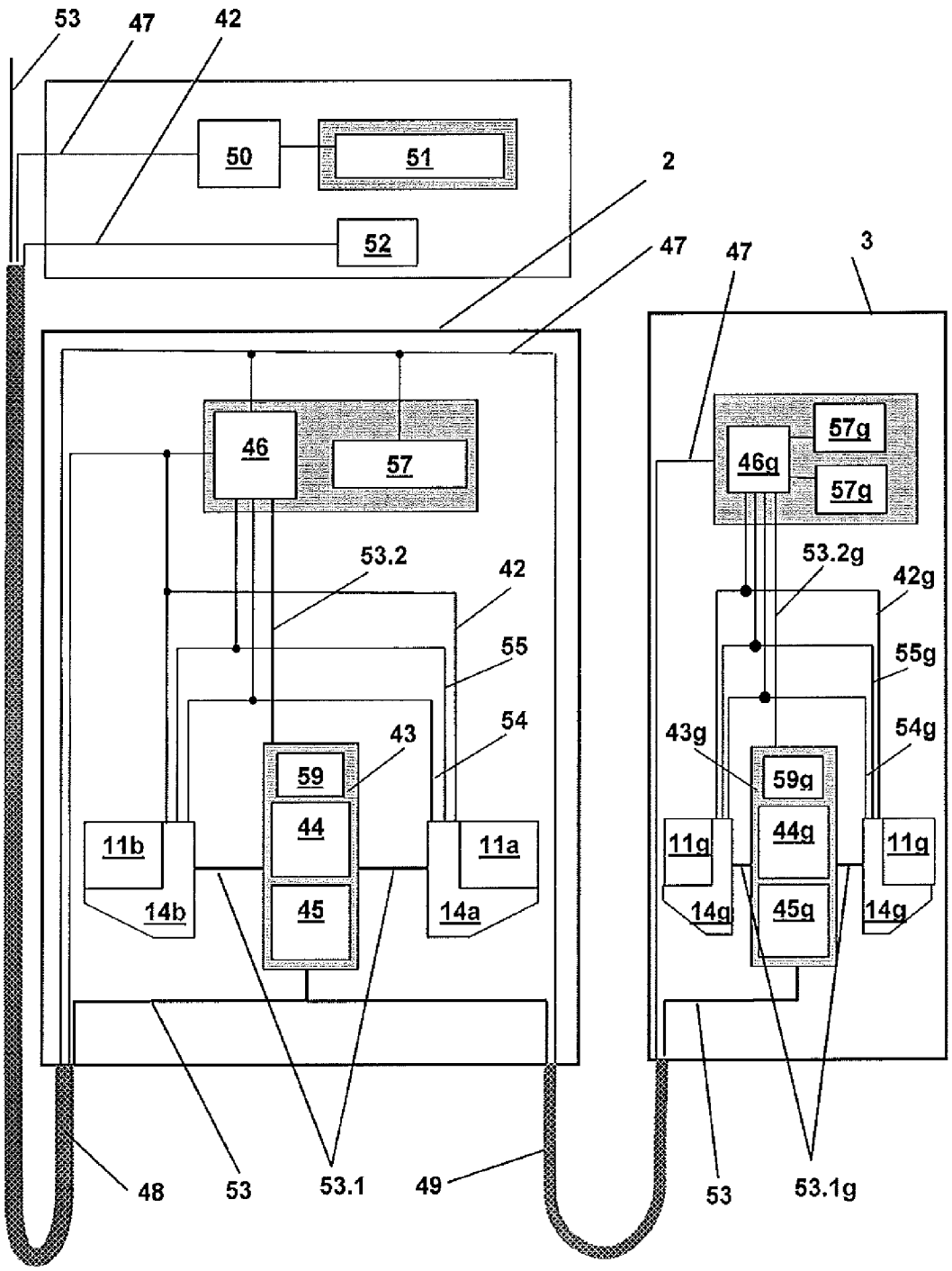
FIG. 4 a diagrammatical representation of a possible electrical interconnection of the safety gears of an elevator system.

Details of this embodiment are described in association with FIG. 4.

In the example shown in FIGS. 1 and 2, the counterweight 3 is also equipped with safety gears 11*g*. These are also suitable for securing and/or delaying the counterweight 3 in the event of an unexpected movement or overspeed. In the example, the safety gear 11*g* is also arranged under the counterweight 3. The counterweight is connected to the car 3 by means of a compensating rope 49. Compensating ropes 49 are particularly used in taller buildings to compensate a weight of the suspension means 4, which moves while the car 2 and counterweight 3 move in opposite directions. In the present example, this compensating rope 49 contains electric conductors which supply electrical energy and electrical signals to the counterweight 3 or a brake control 46*g* arranged thereupon, an energy store 44*g*, and an associated charger 45*g* with voltage converter 59*g*.

The arrangement and function of the safety gear 11*g*, of the device 14*g* for actuating and resetting the safety gear, and of associated parts, can be essentially identical to the embodiment that is shown for the car 2. Self-evidently, the safety gear 11*g* on the counterweight 3 also generally contains a pair of safety gears 11*g* with associated devices for actuating and resetting the respective safety gears.

In the example shown, the counterweight 3 in particular has an own electronic governor or a corresponding speed sensing apparatus 57*g*. This sensing apparatus essentially takes the form of a rotational speed being registered of rollers, for example, of guide rollers. With this arrangement, no further safety-relevant data are required. The compensating rope 49 need therefore not transmit any safety-relevant data.

Figure 3:
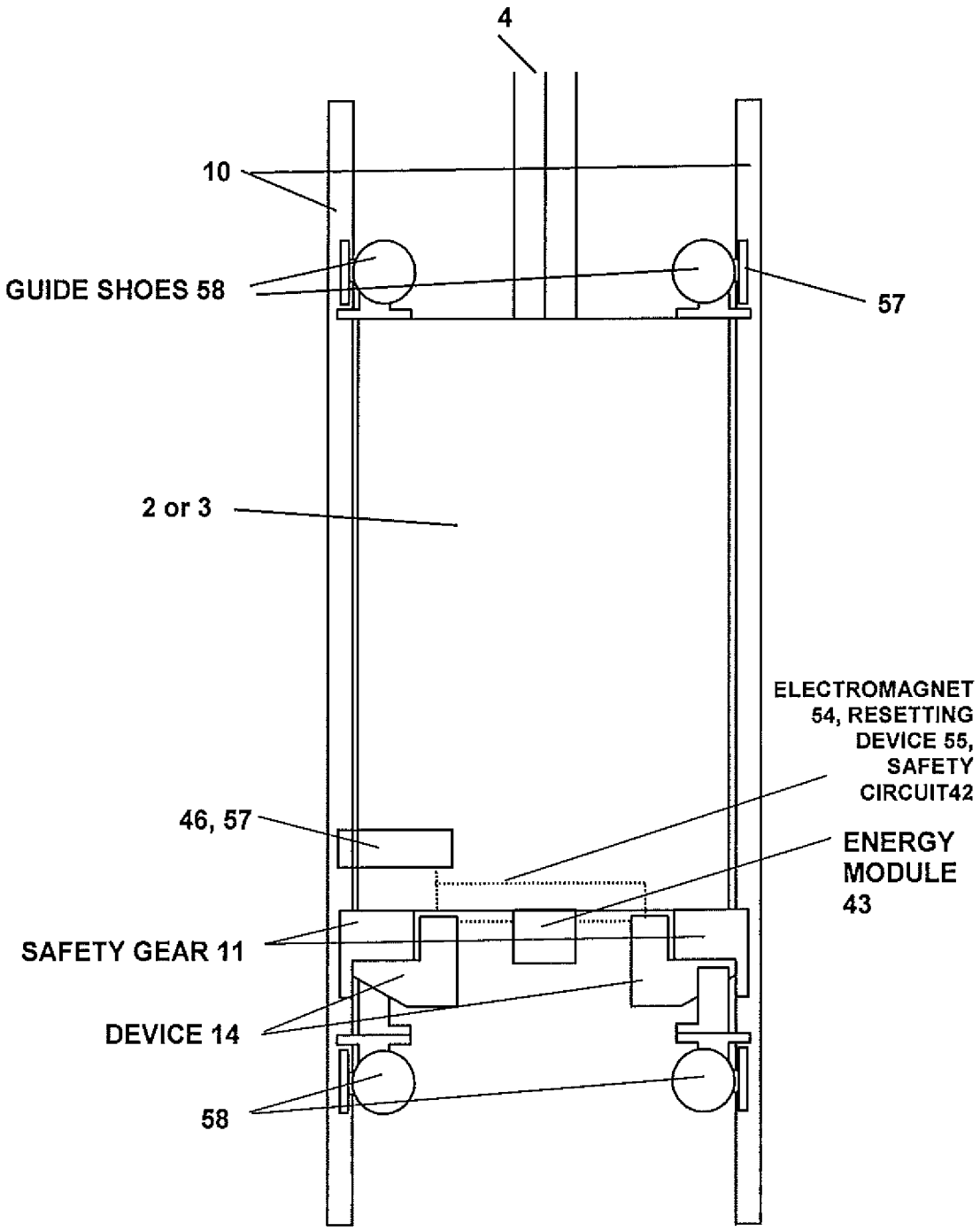
FIG. 3 an elevator car in built-in state in the elevator system.

Shown in FIG. 3 is a traveling body, an elevator car 2 or by analogy a counterweight 3, upon which is mounted a safety gear 11 and associated device 14 for actuating and resetting the safety gear. The elevator car 2 or counterweight 3 is hung on a suspension means 4, and by means of guide shoes 58 is guided along guiderails 10.

Triggering of the safety gear is initialized by an electronic overspeed governor eGB 57 via a brake control 46.

In an embodiment, a rotational speed sensor 57 is integrated in each of at least two rollers. The rollers roll along the guiderails at a speed of travel equal to that of the traveling body. An analysis unit (not shown) compares the signals of the two rotational speed sensors 57 with each other, and determines the true travel speed. Should discrepancies between the signals be detected, an alarm is triggered and the system is brought to a standstill. Should one or both of the signals of the two rotational speed sensors 57 indicate an excessive travel speed, the control circuit of the two devices 14 for actuating and resetting the safety gear is interrupted, and the safety gears 11 are actuated.

Other embodiments of the electronic overspeed governor eGB 57 are possible, for example, as described in the general section. The overspeed governor eGB 57 can be arranged on the car, or on the counterweight, or in the machine room, or is arranged in redundant form in a plurality of locations.

An energy module 43 possibly supplies the electrical energy not only for the brake control but also for the speed detector and for operation of the resetting device. It is generally supplied with electrical energy via a traveling cable or compensating rope.

FIG. 4 shows an exemplary arrangement and electrical connection of the safety gear device in an elevator system.

Arranged in the hoistway 6, possibly in the vicinity of the drive, is the elevator and drive control 50. The elevator and drive control 50 contains a safety circuit 42. This safety circuit 42 is interrupted when the elevator system is in a safety-relevant state that is incompatible with a normal travel. Such a state prevails, for example, when an access door to the car is not correctly closed, or when an emergency switch is actuated, etc. In the case of an interruption of the safety circuit 42, the drive of the elevator system is brought to a standstill and a drive brake 52 is actuated. The elevator and drive control 50 generally also has available information about the travel speed of the drive, which is generally transmitted by a drive rotational-speed transducer 51 to the elevator and drive control 50. The elevator and drive control 50 is possibly further connected by means of a communication bus 47 to the rest of the elevator system, and the elevator system self-evidently has an electrical energy network 53. Located on the car 2 are various further electrical components which, via the traveling cable 48, for example via the communication bus 47 or via the safety circuit 42, are connected to the elevator and drive control 50. These components are additional to further operationally related parts such as door control, lighting etc., the brake control 46, generally an electronic overspeed governor 57, an energy module 43, and the device 14 for actuating and resetting the safety gear. The device 14 for actuating and resetting the safety gear is mounted on the respective safety gear and, in case of need, can actuate and subsequently reset the latter. The device 14 for actuating and resetting the safety gear is triggered by the brake control 46, for example via a control circuit electromagnet 54, to actuate the safety gear 11 and, for example via a control circuit resetting device 55, to reset it. The device 14 for actuating and resetting the safety gear is possibly included in the safety circuit 42. This has the effect that, on triggering of the device 14 for actuating and resetting the safety gear, the safety circuit 42 is opened, and the drive of the elevator system is brought to a standstill. The energy module 43 supplies the brake control 46, and possibly also the device 14 for actuating and resetting the safety gear, with electrical energy. In the example shown, the device 14 for actuating and resetting the safety gear is supplied with a voltage of 12V DC, and the brake control 46 is supplied with a voltage of 24V DC. The energy module 43 has, in addition, an energy store 44 which, in the example, is connected to the energy network 53 via a charger 45, by which it is charged. For the purpose of generating different voltages, in the example, a voltage converter 59 is provided. As a result thereof, standard market products, for example from automobile construction, can be used as, for example, resetting device, since 12V components are often very inexpensively available there.

In the example according to FIG. 4, the counterweight 3 is also equipped with safety gears 11*g*. The safety gears 11*g* themselves are provided with devices 14*g* for actuating and resetting the safety gears, and the counterweight has its own brake control 46*g* and energy module 43*g*, which can be essentially identically constructed, as explained by reference to the example of the car 2. Via a compensating rope 49, the energy network 53 and the communication bus 47 are connected to the counterweight 3. In this embodiment, the safety circuit is not connected to the counterweight 3, but the safety messages of the safety gear 11*g*, and of the device 14*g* for actuating and resetting the safety gear, are processed in the brake control 46*g* and transmitted via the communication channel 47 to the elevator control 50. This embodiment of the counterweight 3 further has a first and a second speed sensing apparatus 57*g*, which measure a travel speed of the counterweight. On the counterweight, the speed sensoring apparatuses are possibly built into rollers. The two speed sensing apparatuses 57*g* can be monitored for correspondence, and from them a certain speed signal can be generated. Based on this certain speed signal, upon detection of an excessive speed of the counterweight, the brake control can operate the safety gears 11*g*. Alternative embodiments and combinations are possible. Instead of the energy network on the counterweight, a following-roller generator can charge the energy accumulator of the counterweight 44*g* and, instead of the wire-connected communication bus, a wireless communication bus can be used. The compensating rope 49 could therefore be dispensed with.

Figure 5:
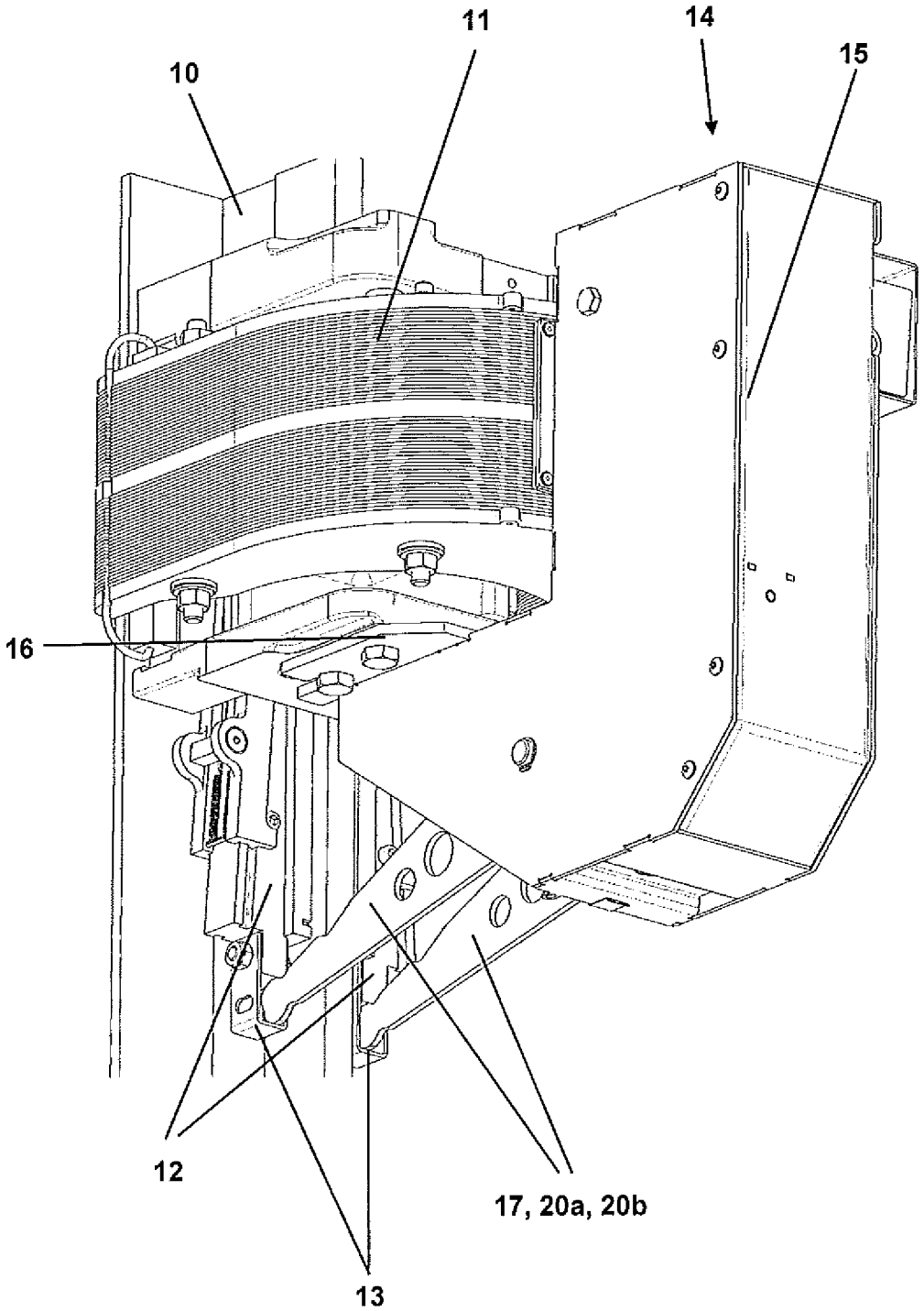
FIG. 5 a single safety gear with built-in device for actuating and resetting the safety gear.

FIG. 5 shows the safety gear 11 with mounted device 14 for actuating and resetting the safety gear. The safety gear 11 is, for example, a simply operating flexible guide clamp safety gear. In case of need, engagement wedges 12 are pressed by the device 14 for actuating and resetting the safety gear, by an actuator 17 by means of lever arms 20*a*, 20*b*, upward into an engaged position, or until the engagement wedges 12 rest against the guiderails 10. The movement of the masses that are to be braked, or of the car 2, or of the counterweight 3, and the friction between the engagement wedge 12 and the rail 10, cause generation of a normal and braking force.

To reset the safety gear, the masses that are to be braked must first be moved upward, so that the engagement wedges 12 can be released from their gripping position. Then, when the friction force between engagement wedge and rail is sufficiently small, the engagement wedge 12 can be reset by the lever arms 20*a*, 20*b* via stirrups 13 downward into a ready position. The device 14 for actuating and resetting the safety gear is bolted to the safety gear 11 by means of a fastening strip 16.

In the example, the safety gear is actuated from below; alternatively, the actuation can take place from above, through the device for actuating and resetting the safety gear pulling the engagement wedges from above, to be actuated, and then pushing the engagement wedges down again, to be reset. Further in the example, the safety gear is used in such manner that it brakes a downward movement of the traveling body, the car or counterweight respectively. The device could also be used with the safety gear in the opposite direction, so that the device for actuating and resetting the safety gear holds the engagement wedges in an upper operating position and, in case of need, moves them downward to brake an unintended upward travel.

Shown in the example is a safety gear 11 with engagement wedges. The presented device for actuating and resetting the safety gear can self-evidently also operate in collaboration with a roller safety gear, wherein engagement rollers are actuated instead of engagement wedges. The use of eccentric safety gears is also possible, the eccentric then being turned by the device for actuating and resetting the safety gear by means of an actuating rod.

In the following FIGS. 6 to 9, a construction and functional process of a device for actuating and resetting the safety device is explained in connection with the safety gear shown in FIG. 5.

Figure 6:
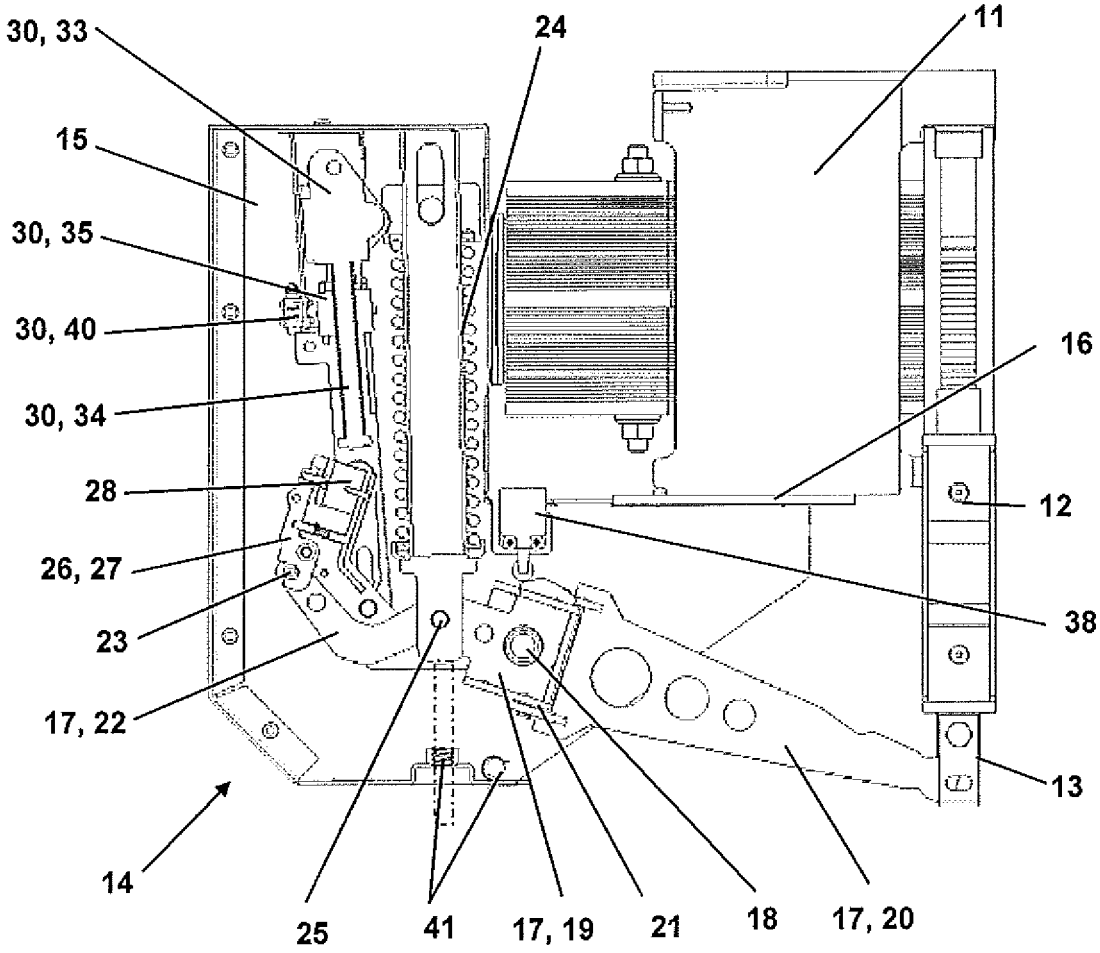
FIG. 6 the device with the safety gear in ready position.

FIG. 6 shows the electrically actuatable safety gear 11 together with the device 14 for actuating and resetting the safety gear in the ready position, as well as a normal position that corresponds to the normal operation of the elevator system. The device 14 for actuating and resetting the safety gear is mounted, possibly bolted, on the safety gear 11 by means of a fastening strip 16. In the normal position shown, the engagement wedges 12 are completely below, and horizontally at several millimeters distance from, the guiderail, so that they cannot come into contact with the latter when the traveling body (not shown) moves. The engagement wedges 12 are held fast by the actuator 17, or by the lever arm 20 that is integrated in the actuator 17, or by the lever arms 20*a*, 20*b* (see FIG. 5) that are integrated in the actuator 17, by means of the stirrups 13. The actuator 17 is mounted swivelably in the housing 15 on a swivel axle 18 and has further a control arm 22 which acts via a restraining nose 23 and a restraining latch 27 together with an electromagnet 28. Via a pressure axle 25, a pressure accumulator 24 (also called a pressure store), embodied in the example as a compression spring, also grips on the control arm 22, or on the actuator 17, and provides an actuating force that is necessary in case of need, which means on release of the restraining nose 23, to actuate the safety gear. FIG. 6 also shows the restraining device 26.

The lever arm 20 is possibly built into the actuator 17 via an articulated joint 21. This joint allows a lateral compensation when the engagement wedge 12, upon moving upward, displaces laterally along an inclined surface of the wedge. Instead of the joint 21, the lever arm 20 itself can self-evidently also be embodied elastically, or the stirrup 13 can be so embodied that a lateral displacement is made possible.

In each case, in the views shown in FIGS. 6 to 9, only 1 lever arm 20 is visible. In connection with FIG. 5, however, it is clear that in each case two lever arms 20*a*, 20*b* that actuate the assigned engagement wedges are arranged mutually adjacent. The lever arms 20*a*, 20*b* are then possibly joined to the actuator 17 via a central swivel body 19.

In the example, the actuator 17 is constructed of various individual parts such as swivel body 19, lever arm 20, 20*a*, 20*b*, and control arm 22. Self-evidently, the actuator can also be constructed in one piece, for example as a casting.

In the example, a lever distance between the stirrup 13 and the swivel axle 18 is selected large by comparison with the control distance between the pressure axle 25 and the swivel axle 18. This lever ratio is approximately 5:1. The resulting engagement travels on the pressure store and control arm are small. This can allow rapid actuation of the safety gear. In an exemplary embodiment, a necessary stroke of the engagement wedge 12, until gripping of the engagement wedge on the guiderails occurs, is approximately 100 mm. Because of the 5:1 ratio, the stroke at the pressure axle is only approximately 20 mm. With a pressure-store force of approximately 1000 N to 1400 N, the mass of the two engagement wedges, which in the example is approximately 2×1.5 kg, can be moved into the engaged position in less than 0.1 seconds. Through measures on the actuator that reduce the mass of the actuator, such as holes in the lever, or lever material of aluminum or other lightweight but strong material, this rapid response time can be optimized.

The force design of the pressure accumulator is selected in such manner that, for example, even on fracture of a compression spring—which is equivalent to the loss of the force of one coil of a spring—sufficient force remains to actuate the safety gear.

The electromagnet 28 is operated by the fail-safe current principle. In other words, a holding force is present as long as current flows. In this state, the electromagnet 28 holds the restraining latch 27 tight, which in turn, via the restraining nose 23, holds the control arm 22, and thereby the pressure accumulator 24, tight. The actuator 17 is thus fixed, and the engagement wedges 12 are held tight via the lever 20 and the stirrup 13. An inadvertent actuation of the engagement wedges, for example through inadvertent contact with the guiderail, is thereby prevented. The position of the actuator 17 is further monitored by a first position sensor 38. In an embodiment, the device 14 for actuating and resetting the safety gear, as is further visible in FIG. 6, is provided with an installation lock 41. As shown in chain-dotted outline in FIG. 6, the installation lock 41 can be used for simple installation in the housing, and then, possibly mechanically, hold the actuator in the ready state. This can allow the device to be simply inserted in the fastening strips and installed. This can be helpful because, during an installation of the safety gear, or of the device for actuating and resetting the safety gear, electrical parts are generally not yet wired. In an advantageous embodiment, this installation lock is coupled with the position sensor 38 to prevent putting the elevator system into operation with the installation lock in place. After installation of the device, or on completion of electrical wiring and triggering of the device 14 for actuating and resetting the safety gear, the installation lock 41 can be removed and, for example, deposited in the housing with a retaining clip, and the device 14 for actuating and resetting the safety gear is then, as previously explained, held in the ready state by the electromagnet 28.

Figure 7:
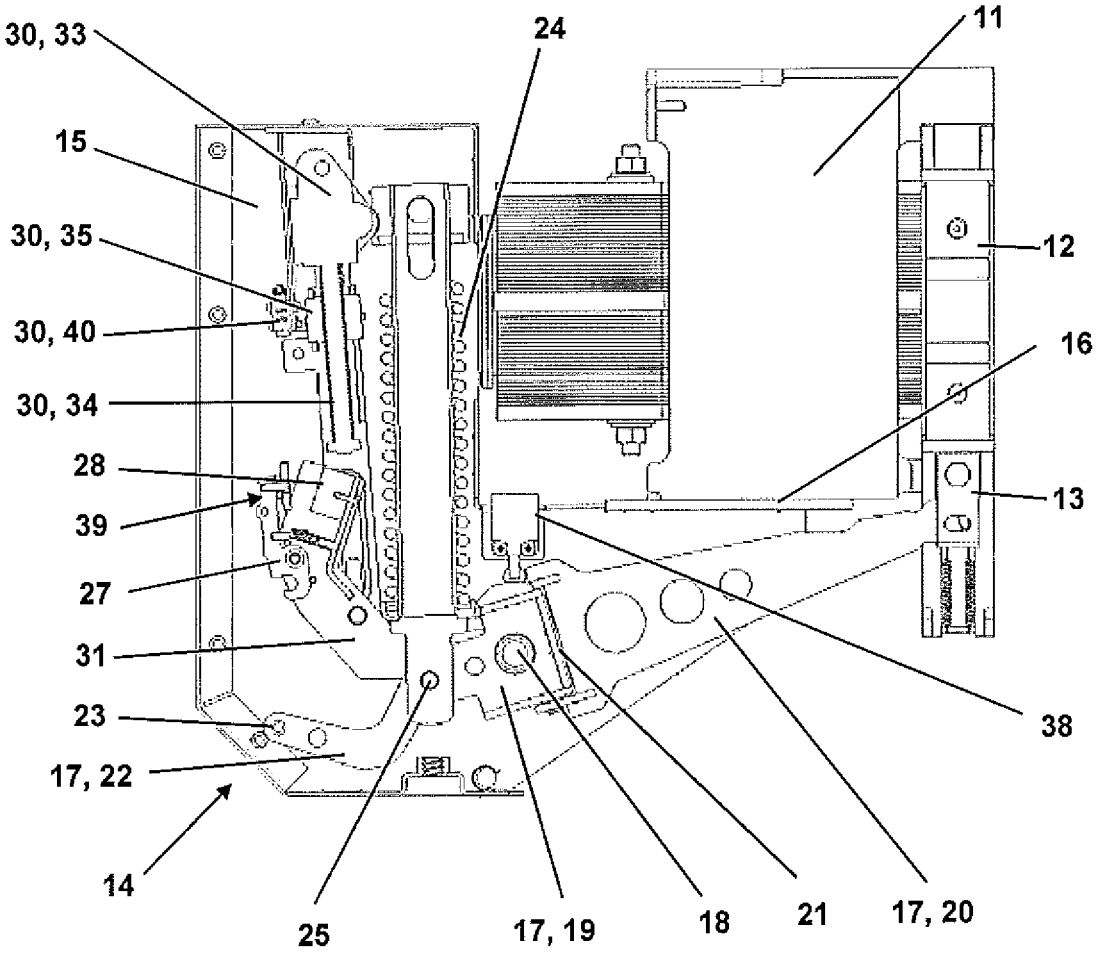
FIG. 7 the device with the safety gear in engaged position.

Should the flow of current in the electromagnet 28 now be interrupted, for example by the brake control 46 (see FIGS. 1 to 4) or another safety device, its magnetic force then disappears. As can be seen in FIG. 7, the restraining latch 27 releases the restraining nose 25 of the control arm 22 or the actuator 17, and the actuating force of the pressure accumulator 24 now presses the engagement wedges 12 upward into the engaged position. The traveling body, or the elevator car or counterweight, is inevitably braked. Simultaneous with actuation of the engagement wedge 12, the first position sensor 38 is actuated, as a result of which the safety circuit 42 of the elevator system (see FIG. 4) is interrupted. Possibly, arranged on the electromagnet 28 is a second position sensor 39, for example a microswitch, which monitors the position of the restraining latch 27 itself. This second position sensor 39 can be used to promptly detect an inadvertent opening of the restraining latch 27, or also to control a resetting of the device 14 for actuating and resetting the safety gear, as described below.

Figure 8:
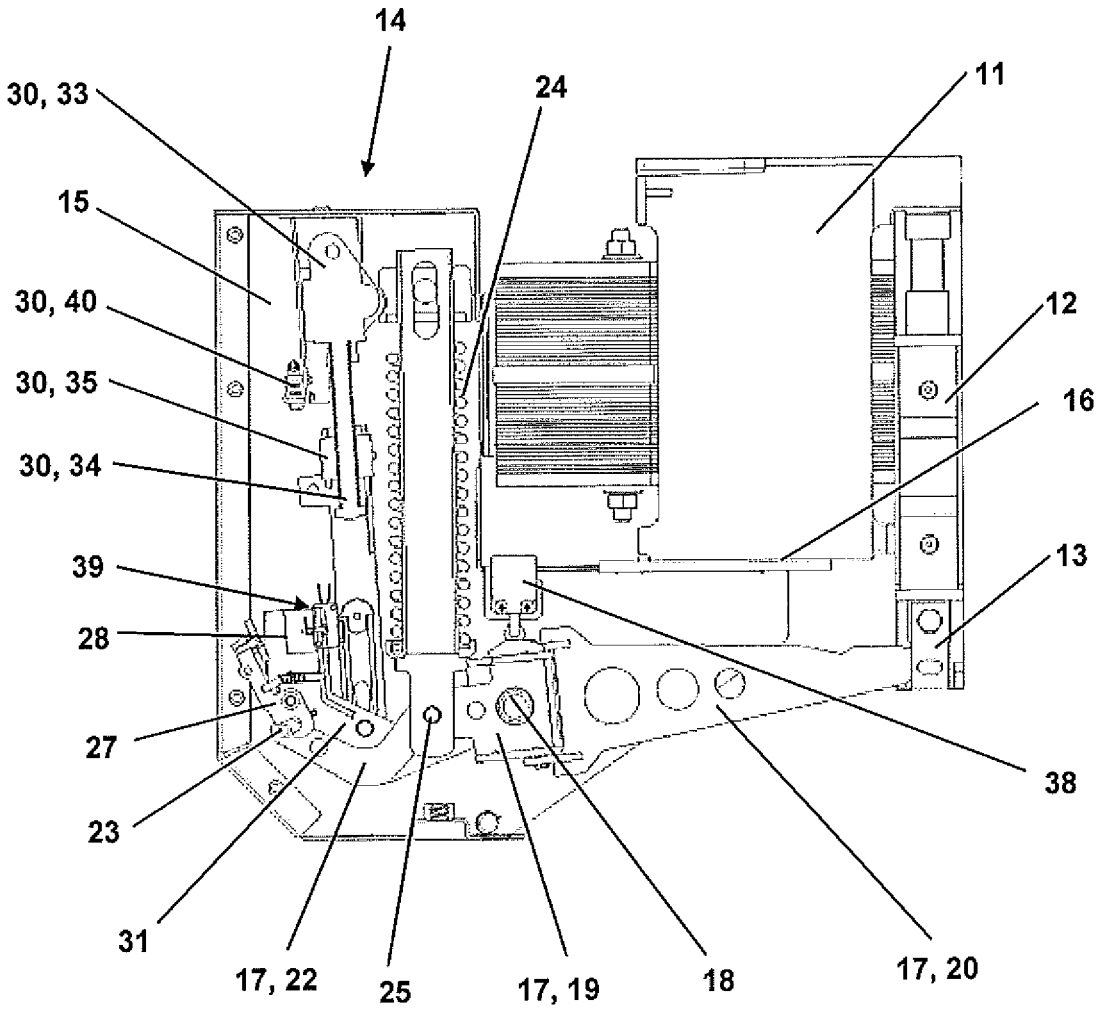
FIG. 8 the device with the safety gear in reset position.
Figure 9:
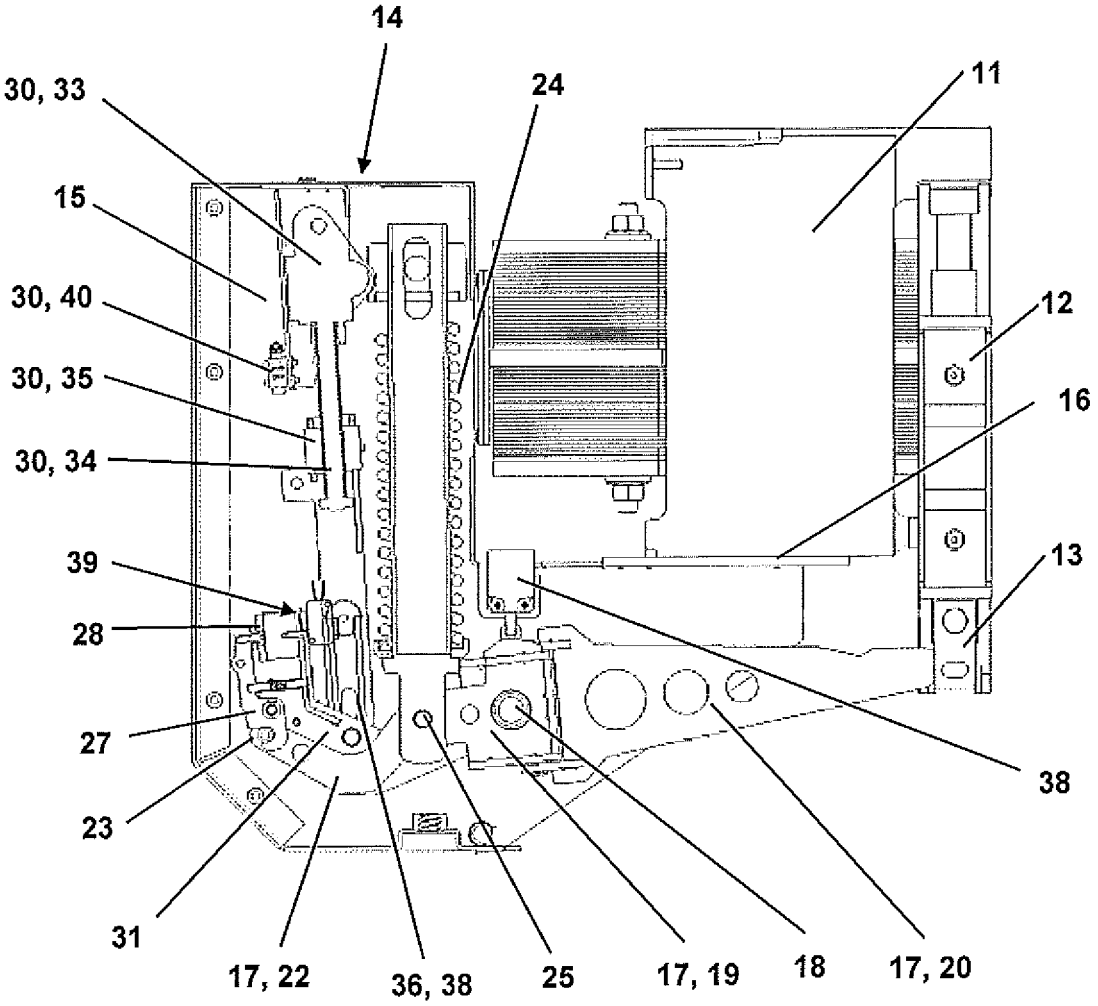
FIG. 9 the device with the safety gear in reset position with closed restraining latch.

In FIGS. 7 to 9, resetting or release of the safety gear is exemplarily shown. For this purpose, the device 14 for actuating and resetting the safety gear contains a return lever 31 on which the electromagnet 28, together with the restraining latch 27 and the second position sensor 39, is arranged. The return lever 31 is swivelably mounted on the swivel axle 18 in such manner that a swivel radius of the restraining nose 23 of the control arm 22, and the restraining latch 27, follow the same swivel path. The return lever 31 is connected to a resetting device 30. In the example, the resetting device 30 contains a spindle slider 35, which is connected to the return lever 31. By means of a spindle axle 34, the spindle slider 35 is moved forward and backward by a spindle drive 33. The resetting device 30 further contains a third position sensor 40, again preferably a microswitch, which detects a retracted position of the spindle slider 35 and therefore of the return lever 31.

Before a resetting is now initialized, the traveling body is generally moved back against the direction of engagement. The engagement wedges 12 are thereby released from their gripping position and rest essentially loosely, or only under a force of the pressure accumulator 24, against the guiderails.

After braking of the traveling body by the safety gear 11 has occurred, and after corresponding actuation of the device 14 for actuating and resetting the safety gear, as this is shown in FIG. 7, the spindle drive 33—after initialization by the brake control 46 (FIG. 4)—swivels, via the swivel axle 34 and the spindle slider 35, the return lever 31 downward to the control lever 22, so that the restraining latch 27 moves to the restraining nose 23, as shown in FIG. 8. On reaching the restraining nose 23, the restraining nose 23 presses the restraining latch 27 back against the switched-on electromagnet 28, which now holds the restraining latch tight 27, as can be seen in FIG. 9. This position is detected by the second position sensor 39. This is also a control input to the brake control to reverse the travel direction of the spindle drive 33 and to move the spindle slider 35, now together with the control arm, into the ready position as shown in FIG. 6. This ready position is reached as soon as the third position sensor 40 is actuated by the moved-back spindle slider 35, as a result of which the resetting is completed and the device 14 for actuating and resetting the safety gear is again in its ready position, since simultaneously with the return of the control arm 22, self-evidently also the pressure accumulator 24 is retensioned. It is apparent that during a retraction of the device, in the event of a faulty behavior of the traveling body, at any time, through switching off the electromagnet 28 the safety gear can now be directly actuated again.

It should further be noted that instead of the spindle resetting, self-evidently also other drive types, such as a linear motor or another swivel drive, can be used. A spindle drive can be advantageous since such spindle drives are frequently used, for example, for the operation of car windows, and can be correspondingly inexpensive to obtain.

Further advantageous additions are also to be seen in FIGS. 6 to 9.

In one embodiment, for example, the spindle slider 35 is connected to the return lever via a force limiter 36, for example a latching spring 37. By this means, overloading of the resetting device 30 is prevented when the traveling body itself is moved during the resetting movement, because of which an unexpected pressure force could act on the resetting device via the engagement wedges 12. The force limiter 36 limits the pressure force in the resetting device, or in the spindle axle 34, to approximately 100 N. Should the maximum value be exceeded, the tensioning lever can move into a free-running position. To engage the tension lever again, the tension member is moved upward.

Further, a form of the restraining latch 27 is so selected that the restraining latch is opened again when, for example, the still-wedged engagement wedges 12 prevent themselves from being withdrawn. In this case, the restraining latch can be reopened by the force of the resetting device 30. Since at this moment the second position sensor 39 is also reopened or reactuated, the brake control can recognize this state and restart the resetting.

Figure 10:
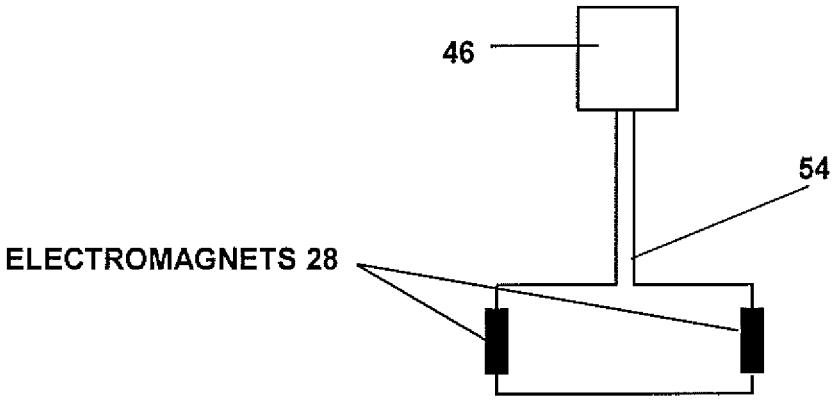
FIG. 10 a series connection of a pair of electromagnets of the device for actuating and resetting the safety gear.

FIG. 10 shows an advantageous connection of the electromagnets 28 in a typical use of two devices for actuating and resetting a pair of safety gears. Here, as explained in FIGS. 1 to 4, in each case a device for actuating and resetting the safety gear is connected to a safety gear. The two electromagnets 28 are hereby connected in series, and provided with a necessary holding current via the brake control 46. With this series connection, the two devices for actuating and resetting the safety gear are electrically synchronized accurate to milliseconds. The two safety gears to be actuated therefore trigger simultaneously.

At the same time, it can be assured that in the case of an electrical interruption in a coil of the electromagnets 28, both safety gears trigger, and no damaging one-sided engagement occurs. A mechanical synchronization with a lever linkage is no longer necessary.

Figure 11:
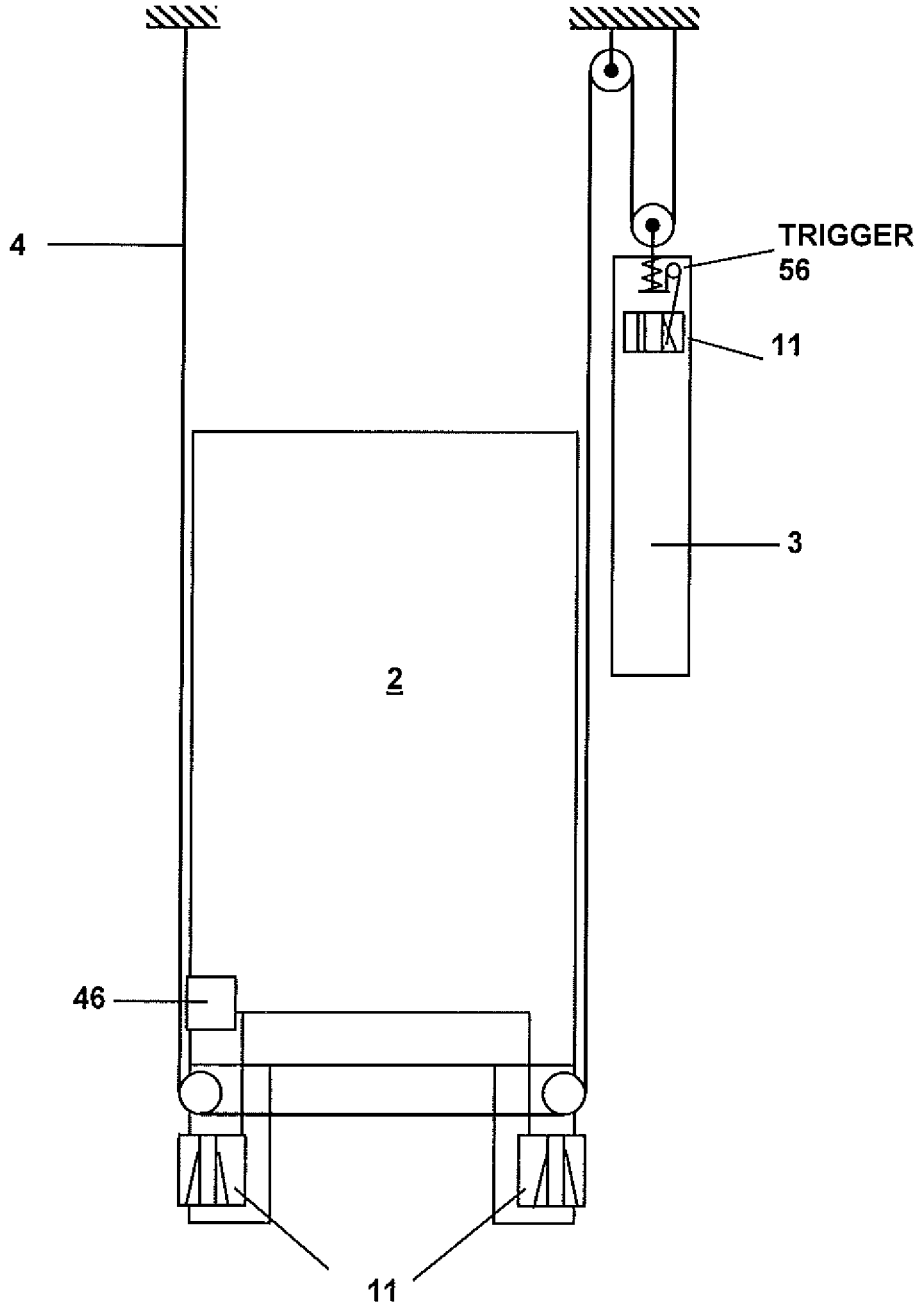
FIG. 11 another variant configuration of an elevator system with car and counterweight with integrated safety device.

Shown in FIG. 11 is an augmentary or alternative embodiment of the safety concept of an elevator system 1 shown in FIGS. 1 to 3. Here, the elevator car 2 with safety gears 11 and associated devices 14 for actuating and resetting the safety gear is equipped with a brake control 46 as previously described. The difference is that the counterweight 3 is equipped with a safety gear 11*g* which is actuated by a slack-rope trigger 56. This means that the safety gear 11*g* is actuated when a suspension force falls below a preset value for a predefined period of time. Hence, for example, should the suspension means 4 in the elevator system break, the safety gear of the elevator car 2 would be actuated via the brake control 46, and the elevator car would be safely braked, and due to the now suddenly absent suspension force in the suspension means, the slack-rope trigger 56 would actuate the safety gear 11*g* of the counterweight and secure the counterweight 3 against falling. By means of a delaying or damping device in the slack-rope trigger 56, it can be ensured that a momentary oscillation effect does not trigger the safety gear 11*g*.

With knowledge of the present disclosure, the elevator specialist can change the set forms and arrangements at will. For example, the brake control 46 and/or the energy module 43 and/or the speed sensors 57 can be embodied as separate subassemblies, or these subassemblies can be combined into a safety package. This safety package can also be part of an elevator control. The device for actuating and resetting the safety gear can be mounted on a safety gear as a subassembly, or it can also be built into essentially the same housing as a safety gear.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator system device, comprising:

a pressure accumulator;

a remotely actuatable resetting device, the remotely actuatable resetting device being configured to place the pressure accumulator in a ready position for the pressure accumulator;

an actuator, the actuator being connected to the pressure accumulator and connected to an engagement element of a safety gear, the engagement element being configured to contact a braking surface or a guiderail, the actuator being configured to hold the engagement element in a ready position for the engagement element and further configured to move the engagement element into an engaged position on release of the pressure accumulator; and a restraining device, the restraining device comprising a restraining latch, the restraining latch being holdable by an electromagnet and triggerable by a spring force, the restraining latch being configured to hold the actuator in a ready position for the actuator.

2. The elevator system device of claim 1, the actuator being swivelably mounted about an essentially horizontal swivel axle of the elevator system device, the actuator being configured to move a plurality of engagement elements of the safety gear essentially synchronously into an engaged position.

3. The elevator system device of claim 2, the plurality of engagement elements comprising a plurality of engagement wedges.

4. The elevator system device of claim 1, the pressure accumulator comprising a compression spring.

5. The elevator system device of claim 1, the actuator comprising:

a swivel body;

two lever arms, the two lever arms being connectable to an engagement wedge of the safety gear; and a control arm, the control arm connecting the swivel body to the pressure accumulator and to the restraining device.

6. The elevator system device of claim 1, further comprising:

a first position sensor, the first position sensor being configured to monitor an operation position of the actuator; and a second position sensor, the second position sensor being configured to monitor an operating position of the restraining latch.

7. The elevator system device of claim 6, the first position sensor comprising a safety switch.

8. The elevator system device of claim 6, the second position sensor comprising a microswitch.

9. The elevator system device of claim 1, the restraining device being swivelably mounted on a swivel axle of the actuator, the remotely actuatable resetting device being further configured to, move the restraining device from a ready position for the restraining device into a return position for the restraining device, and after a latching of the restraining latch of the restraining device in a control arm of the actuator, move the restraining device with the control arm into the ready position for the restraining device, the movement of the control arm placing the pressure accumulator into the ready position for the pressure accumulator.

10. The elevator system device of claim 1, further comprising a position sensor, the position sensor being configured to monitor the ready position for the pressure accumulator, the ready position for the engagement element, or a ready position for the remotely actuatable resetting device.

11. The elevator system device of claim 1, the remotely actuatable resetting device comprising a spindle drive and a spindle slider, the spindle slider being movable by a spindle of the spindle drive and connected to a return lever, the spindle drive being configured to move the return lever.

12. The elevator system device of claim 1, the remotely actuatable resetting device comprising a force limiting device, the force limiting device being configured to decouple the restraining device from the remotely actuatable resetting device when a predefined resetting force is exceeded.

13. The elevator system device of claim 1, further comprising a mechanical lock configured to block the elevator system device in a ready position of the elevator system device.

14. The elevator system device of claim 1, further comprising a housing, the housing comprising a fastening strip for mounting the housing on the safety gear.

15. An elevator system comprising:

at least one traveling body, the at least one traveling body being movably arranged along at least two guiderails in an elevator hoistway;

first and second elevator system devices coupled to the at least one traveling body, each of the first and second elevator system devices comprising, a pressure accumulator, a remotely actuatable resetting device, the remotely actuatable resetting device being configured to place the pressure accumulator in a ready position for the pressure accumulator, an actuator, the actuator being connected to the pressure accumulator and connected to an engagement element of a safety gear, the engagement element being configured to contact a braking surface or a guiderail, the actuator being configured to hold the engagement element in a ready position for the engagement element and further configured to move the engagement element into an engaged position on release of the pressure accumulator, and a restraining device, the restraining device comprising a restraining latch, the restraining latch being holdable by an electromagnet and triggerable by a spring force, the restraining latch being configured to hold the actuator in a ready position for the actuator.

16. The elevator system of claim 15, the electromagnet of first elevator system device being connected in series with the electromagnet of the second elevator system device.

17. The elevator system of claim 15, the at least one traveling body comprising an elevator car, the first elevator system device being connected to an electronic safety device, the electronic safety device being configured to detect a difference between a travel speed of the elevator car and a reference speed and, as a result of the detected difference, trigger the first elevator system device for activating the safety gear.

18. The elevator system of claim 15, the first and second elevator system devices being configured to receive electrical energy from an energy store.

19. The elevator system of claim 15, the at least one traveling body comprising a counterweight, the first elevator system device further comprising a speed monitoring device.

* * * * *